US006321619B1

(12) United States Patent
Itoh

(10) Patent No.: US 6,321,619 B1
(45) Date of Patent: Nov. 27, 2001

(54) OPENER FOR SPECIMEN CONTAINER

(76) Inventor: Teruaki Itoh, 5-25, Kokaihommachi, Kumamoto-shi, Kumamoto-ken (JP)

( * ) Notice: Subject to any disclaimer, the term of this patent is extended or adjusted under 35 U.S.C. 154(b) by 0 days.

(21) Appl. No.: 09/579,043

(22) Filed: May 26, 2000

(30) Foreign Application Priority Data

May 31, 1999 (JP) ..... 11-152471

(51) Int. Cl.[7] ..... B67B 7/02
(52) U.S. Cl. ..... 81/3.2; 81/3.33
(58) Field of Search ..... 81/3.2, 3.31, 3.33, 81/3.36, 3.37

(56) References Cited

U.S. PATENT DOCUMENTS 4,876,926 * 10/1989 Muszak ..... 81/3.2
5,255,574 * 10/1993 Wuerschum ..... 81/3.2
5,826,409 * 10/1998 Slepicka ..... 53/492
6,142,039 * 11/2000 Herring, Sr. ..... 81/3.2

* cited by examiner

*Primary Examiner*—Joseph J. Hail, III
*Assistant Examiner*—David B. Thomas
(74) *Attorney, Agent, or Firm*—Volpe and Koenig, P.C.

(57) ABSTRACT

An opener for a specimen container includes a first chuck mechanism placed in a specific position of a transfer lane for transferring the specimen container, for chucking and fixing the specimen container which is transferred to the specific position and whose opening is stopped with a stopper, a second chuck mechanism for chucking the stopper, which stops the opening of the specimen container chucked and fixed by the first chuck mechanism, from two directions perpendicular to an axis of the specimen container, a rotation driving mechanism for rotating the second chuck mechanism around the axis of the specimen container, and a pull-out mechanism for moving the second chuck mechanism away from the opening of the specimen container along the axis of the specimen container in synchronization with a rotating operation of the rotation driving mechanism.

4 Claims, 2 Drawing Sheets

OPENER FOR SPECIMEN CONTAINER

CROSS-REFERENCE TO RELATED APPLICATIONS

This application is based upon and claims the benefit of priority from the prior Japanese Patent Application No. 11-152471, filed May 31, 1999 the entire contents of which are incorporated herein by reference.

BACKGROUND OF THE INVENTION

The present invention relates to an opener for automatically pulling a stopper out of an opening of a specimen container such as a test tube containing blood.

As one conventional device of this type, there is an opener so constituted that a stopper is simply pulled up vertically from a specimen container in a specific position on a transfer lane.

However, the conventional opener has the following problem. Since the stopper is simply pulled up vertically, the pull-up operation becomes difficult and requires a long time depending on the inserting pressure of the stopper against the specimen container and the materials (e.g., rubber, plastic, cork) therefore.

BRIEF SUMMARY OF THE INVENTION

The object of the present invention is to provide an opener for a specimen container which is capable of quickly and accurately pulling a stopper out of a specimen container, regardless of the inserting pressure of the stopper against the specimen container, the materials for the stopper, or the like.

In order to attain the above object, the opener of the present invention has the following principal features. The other features will be clarified later in the Detailed Description of the Invention.

An opener for a specimen container according to one aspect of the present invention, comprises:

- a first chuck mechanism placed in a specific position of a transfer lane for transferring the specimen container, for chucking and fixing the specimen container which is transferred to the specific position and whose opening is stopped with a stopper;
- a second chuck mechanism for chucking the stopper, which stops the opening of the specimen container chucked and fixed by the first chuck mechanism, from two directions perpendicular to an axis of the specimen container;
- a rotation driving mechanism for rotating the second chuck mechanism around the axis of the specimen container; and
- a pull-out mechanism for moving the second chuck mechanism away from the opening of the specimen container along the axis of the specimen container in synchronization with a rotating operation of the rotation driving mechanism.

In the opener described above, the rotation driving mechanism includes forward/backward rotation control means for rotating the second chuck mechanism forward and backward such that the stopper turns forward first, then backward, and forward again in a single pull-out step, and the pull-out mechanism includes lifting/lowering control means for lifting and lowering the second chuck mechanism such that the stopper is lifted first, then lowered, and lifted again in a single pull-out step.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

Embodiment

[Structure]

Figure 1:
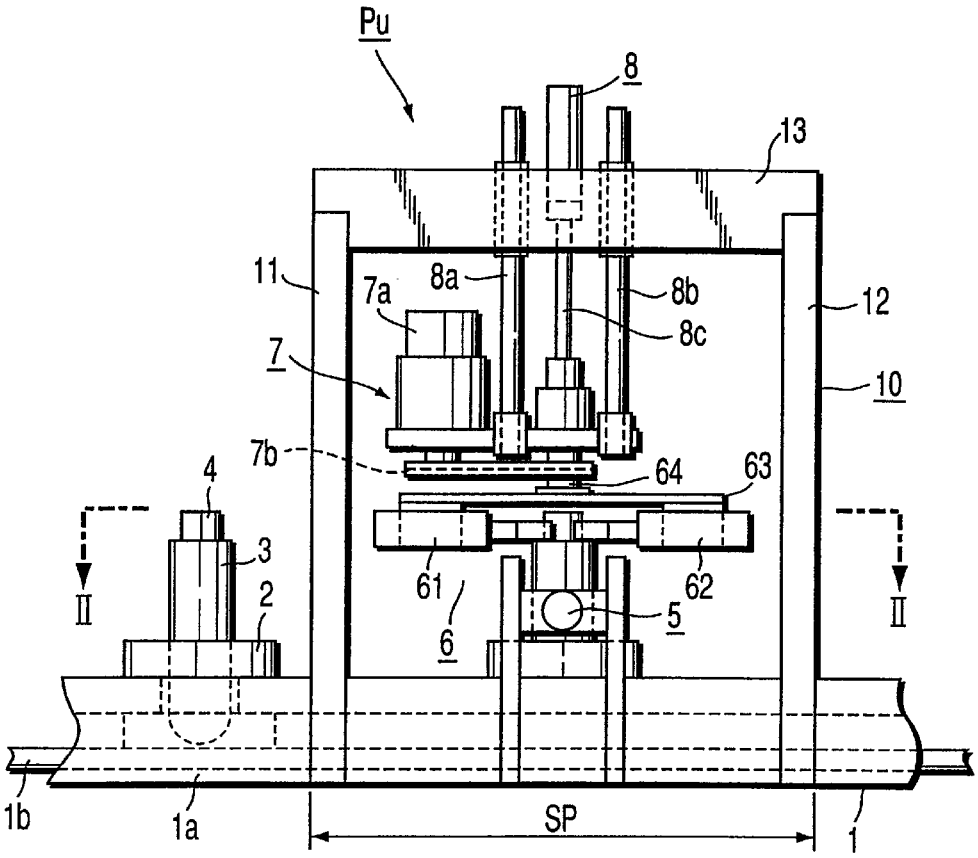
FIG. 1 is a front view illustrating a structure of an opener for a specimen container according to one embodiment of the present invention.
Figure 2:
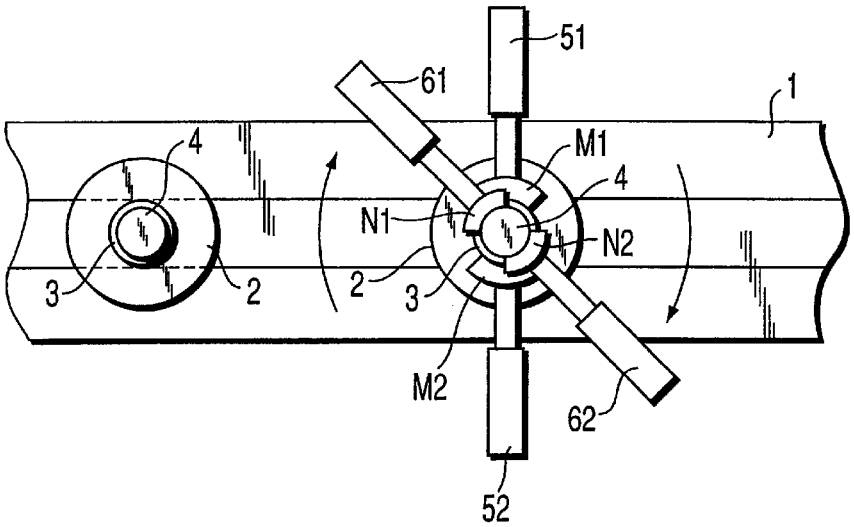
FIG. 2 is a top view taken along line II—II of FIG. 1.

As illustrated in FIGS. 1 and 2, a transfer lane 1 for transferring a specimen container 3, such as a test tube, is constituted of a lane body 1*a* and a belt conveyor mechanism 1*b* provided on the inner bottom surface of the lane body 1*a* movably along a longitudinal direction thereof. The transfer lane 1 is mounted on a mounting base (not shown). If an almost cylindrical specimen container holder 2 is transferred by the conveying operation of the belt conveyor mechanism 1*b*,then the specimen container 3 held in the holder 2 is transferred on the transfer lane 1. The specimen container 3 contains a specimen such as blood and its opening is liquid-tightly sealed with a stopper 4.

A specimen-container opener device PU is set in a specific position SP of the transfer lane 1. The opener device PU includes a first chuck mechanism 5, a second chuck mechanism 6, a rotation driving mechanism 7, and a pull-out mechanism 8. The first chuck mechanism 5 is directly mounted on the mounting base (not shown), and the second chuck mechanism 6, rotation driving mechanism 7 and pull-out mechanism 8 are hung from above by means of a support mechanism 10 (described later) mounted on the mounting base (not shown).

The first chuck mechanism 5 fixedly chucks the specimen container 3, which is transferred to the specific position SP, from both sides. In other words, the chuck mechanism 5 is so constituted that the outer surface of the specimen container 3 can be chucked securely by bringing a pair of press chucks M1 and M2 closer together or separating them from each other using a pair of air piston/cylinder devices 51 and 52 advancing or retreating in a direction perpendicular to the transfer direction of the transfer lane 1 within a horizontal plane.

The second chuck mechanism 6 is provided so as to chuck the stopper 4 of the specimen container 3, which is fixed in the specific position SP by the first chuck mechanism 5, from two directions perpendicular to the axis of the specimen container 3. In other words, the second chuck mechanism 6 securely chucks the outer surface of the stopper 4 by bringing a pair of press chucks N1 and N2 closer together or separating them from each other using a pair of air piston/cylinder devices 61 and 62 advancing or retreating in a direction parallel to the transfer direction of the transfer lane 1.

Upper portions of the piston/cylinder devices 61 and 62 are hung and supported by a support arm 63. A central part of the support arm 63 is fixed to a rotating shaft 64. An axis of the rotating shaft 64 coincides with an axis of the specimen container 3 fixed in the specific position SP by the first chuck mechanism 5. Consequently the second chuck mechanism 6 supported by the support arm 63 can rotate within the horizontal plane and around the rotating shaft 64 or the axis of the specimen container 3.

The rotation driving mechanism 7 serves to rotate the second chuck mechanism 6. More specifically, the mechanism 7 includes an air actuator 7*a* and transmits its driving force to the rotating shaft 64 through a belt 7*b* to rotate the second chuck mechanism 6.

The air actuator 7*a* is placed and fixed on a support substrate 7*c*. The support substrate 7*c* has a mounting hole. The rotating shaft 64 is fixed into the mounting hole such that it can rotate relatively in its radial direction and it cannot move in its thrust direction.

Though not shown, the rotation driving mechanism 7 includes both a forward/backward rotation control means and a speed control means.

The pull-out mechanism 8 is placed higher than the second chuck mechanism 6 and rotation driving mechanism 7 to move the second chuck mechanism 6 away from the opening of the specimen container 3 along the axis of the container 3 in synchronization with the rotation of the mechanism 7. The mechanism 8 is constituted chiefly of an air piston/cylinder device 8*c* which is vertically fixed to a mounting bridge 13 formed horizontally between the top ends of columns 11 and 12 of the support mechanism 10. The device 8*c* can pull up the rotating shaft 64 and support substrate 7*c* in synchronization with a rotating operation of the rotation driving mechanism 7. The pull-out mechanism 8 includes a pair of support poles 8*a* and 8*b* on its both sides. The support poles 8*a* and 8*b* support the support substrate 7*c* so as to prevent the substrate 7*c* from rotating when the mechanism 7 rotates, and holds the substrate 7*c* horizontally so as to stably perform when the pull-out mechanism 8 operates.

Though not shown, the pull-out mechanism 8 includes both a lifting/lowering control means and a speed control means.

[Operation]

The above-described opener for a specimen container according to the embodiment of the present invention operates as follows.

When the specimen container 3 held in the specimen container holder 2 is transferred to the specific position SP on the transfer lane 1, it is stopped temporarily by a stopper (not shown) set in the specific position SP. The first chuck mechanism 5 thus operates to chuck the outer surface of the specimen container 3. The container 3 is thus fixed in the specific position SP and almost simultaneously the second chuck mechanism 6 operates to chuck the stopper 4 of the container 3. In other words, the stopper 4 is chucked by the second chuck mechanism 6 from two directions perpendicular to the axis of the container 3.

In such a state, the rotation driving mechanism 7 and the pull-out mechanism 8 start to operate almost at the same time. On one hand the mechanism 7 starts to rotate the rotating shaft 64 and thus the piston/cylinder devices 61 and 62 of the second chuck mechanism 6 starts to rotate in the direction indicated by the arrows in FIG. 2; on the other hand the mechanism 8 causes its piston/cylinder device 8c to start a pull-out operation. Therefore, the second chuck mechanism 6 and rotation driving mechanism 7 start to move away from the opening of the specimen container 3 along the axis of the container 3.

Figure 3:
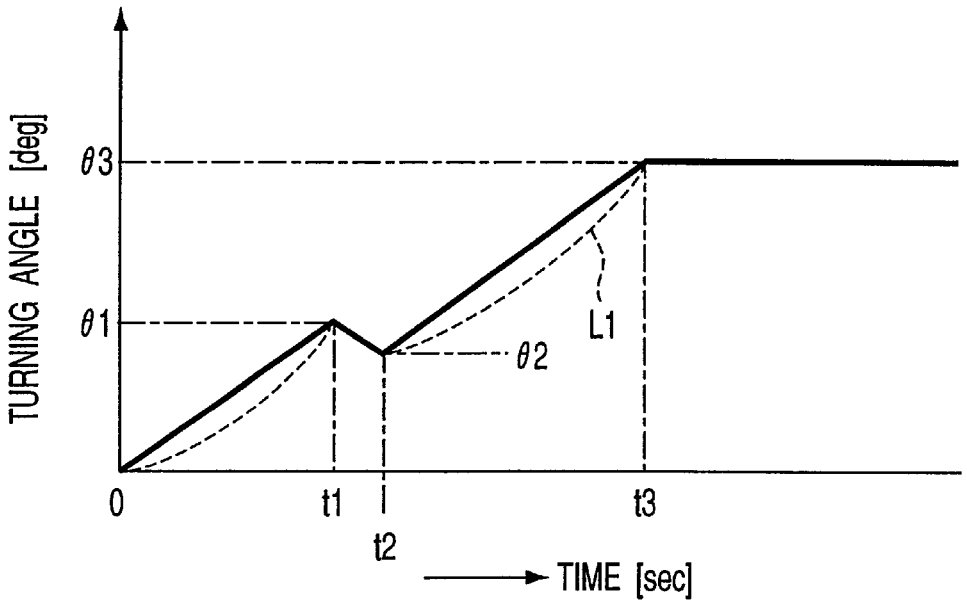
FIG. 3 is a graph showing a relationship between time and turning angle to explain an operation of the opener according to the embodiment of the present invention.
Figure 4:
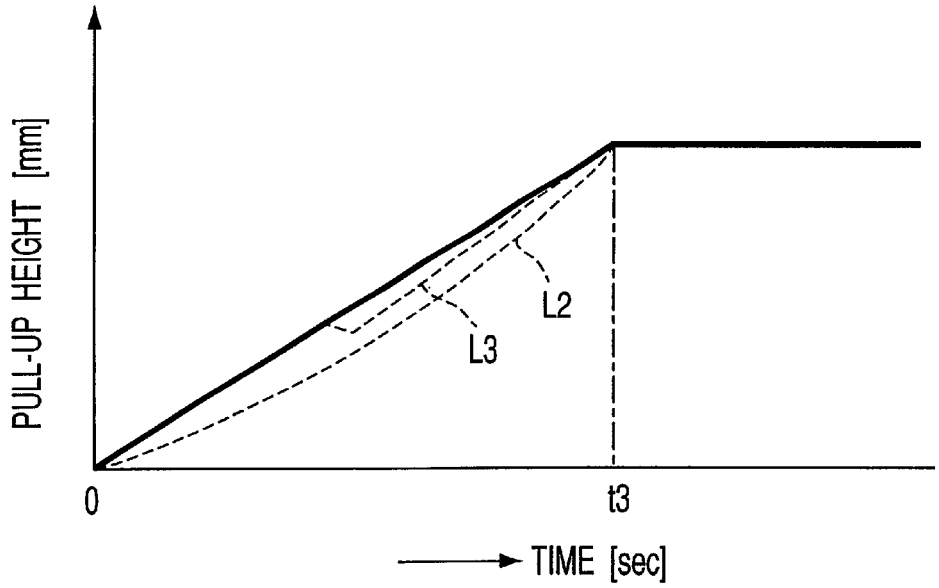
FIG. 4 is a graph showing a relationship between time and pull-up height to explain an operation of the opener according to the embodiment of the present invention.

FIG. 3 shows a relationship between the time lapse and the turning angle of the stopper 4 turned by the rotation driving mechanism 7, while FIG. 4 does a relationship between the time lapse and the pull-up height of the stopper 4 pulled out by the pull-out mechanism 8.

As indicated by the solid line in FIG. 3, the stopper 4 is turned forward until time t1, then turned backward slightly from t1 to t2, and turned forward again from t2 to t3. As indicated by the solid line in FIG. 4, the stopper 4 is pulled up at a constant speed until time t3.

The stopper 4 is thus turned and pulled up by the mechanisms 7 and 8, respectively, in synchronization with each other. The turning force of the rotation driving mechanism 7 and the pull-out force of the pull-out mechanism 8 are both applied to the stopper 4 by which the opening of the specimen container 3 is stopped. Consequently a very stable pull-out force acts on the stopper 4 and the stopper 4 can be pulled out quickly and accurately.

The stopper 4 is turned forward first, then turned backward, and continuously turned forward again in the single pull-out step. Even though the stopper 4 is deformed or bent due to some causes after it starts to turn, the deformation or bent is automatically restored during the backward turn of the stopper 4. As a result, even though the stopper 4 is formed of, e.g., soft rubber which is easy to deform or bend, the turn and pull-out operations can be performed stably.

Modifications

The opener for a specimen container according to the embodiment of the present invention can be modified as follows:

1) As indicated by broken lines L1, L2 in FIGS. 3 and 4, the turn and pull-up operations of the stopper 4 can be performed at a relatively low speed when they start, and then the speed is increased gradually. It is thus possible to inhibit a sudden stress from being applied to the stopper 4 and thus prevent the stopper 4 from being broken by the sudden stress.

2) As indicated by broken line L3 in FIG. 4, the pull-up operation of the stopper 4 can be performed such that the stopper 4 is pulled up first, then pulled down, and pulled up again.

3) The direction of at least one of the turn and pull-up operations can be reversed two or more times.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An opener for a specimen container, comprising:

a first chuck mechanism placed in a specific position of a transfer lane for transferring the specimen container, for chucking and fixing the specimen container which is transferred to the specific position and whose opening is stopped with a stopper;

a second chuck mechanism for chucking the stopper, which stops the opening of the specimen container chucked and fixed by the first chuck mechanism, from two directions perpendicular to an axis of the specimen container;

a rotation driving mechanism for rotating the second chuck mechanism around the axis of the specimen container; and a pull-out mechanism for moving the second chuck mechanism away from the opening of the specimen container along the axis of the specimen container in synchronization with a rotating operation of the rotation driving mechanism and wherein the rotation driving mechanism includes forward/backward rotation control means for rotating the second chuck mechanism forward and backward such that the stopper turns forward first, then backward, and forward again in a single pull-out step.

2. An opener for a specimen container, comprising:

a first chuck mechanism placed in a specific position of a transfer lane for transferring the specimen container, for chucking and fixing the specimen container which is transferred to the specific position and whose opening is stopped with a stopper;

a second chuck mechanism for chucking the stopper, which stops the opening of the specimen container chucked and fixed by the first chuck mechanism, from two directions perpendicular to an axis of the specimen container;

a rotation driving mechanism for rotating the second chuck mechanism around the axis of the specimen container; and a pull-out mechanism for moving the second chuck mechanism away from the opening of the specimen container along the axis of the specimen container in synchronization with a rotating operation of the rotation driving mechanism and wherein the pull-out mechanism includes lifting/lowering control means for lifting and lowering the second chuck mechanism such that the stopper is lifted first, then lowered, and lifted again in a single pull-out step.

3. An opener for a specimen container, comprising:

a first chuck mechanism placed in a specific position of a transfer lane for transferring the specimen container, for chucking and fixing the specimen container which is transferred to the specific position and whose opening is stopped with a stopper;

a second chuck mechanism for chucking the stopper, which stops the opening of the specimen container chucked and fixed by the first chuck mechanism, from two directions perpendicular to an axis of the specimen container;

a rotation driving mechanism for rotating the second chuck mechanism around the axis of the specimen container; and a pull-out mechanism for moving the second chuck mechanism away from the opening of the specimen container along the axis of the specimen container in synchronization with a rotating operation of the rotation driving mechanism and wherein the rotation driving mechanism includes forward/backward rotation control means for rotating the second chuck mechanism forward and backward such that the stopper turns forward first, then backward, and forward again in a single pull-out step, and the pull-out mechanism includes lifting/lowering control means for lifting and lowering the second chuck mechanism such that the stopper is lifted first, then lowered, and lifted again in a single pull-out step.

4. An opener for a specimen container, comprising:

a first chuck mechanism placed in a specific position of a transfer lane for transferring the specimen container, for chucking and fixing the specimen container which is transferred to the specific position and whose opening is stopped with a stopper;

a second chuck mechanism for chucking the stopper, which stops the opening of the specimen container chucked and fixed by the first chuck mechanism, from two directions perpendicular to an axis of the specimen container;

a rotation driving mechanism for rotating the second chuck mechanism around the axis of the specimen container; and a pull-out mechanism for moving the second chuck mechanism away from the opening of the specimen container along the axis of the specimen container in synchronization with a rotating operation of the rotation driving mechanism and wherein at least one of the rotation driving mechanism and the pull-out mechanism includes speed control means for performing an operation of the stopper at a relatively low speed when the operation starts and then increasing the speed gradually.

* * * * *